US005892489A

United States Patent [19]

Kanba et al.

[11] Patent Number: 5,892,489

[45] Date of Patent: Apr. 6, 1999

[54] CHIP ANTENNA AND METHOD OF MAKING SAME

[75] Inventors: Seiji Kanba, Otsu; Kenji Asakura, Shigu-ken; Tsuyoshi Suesada, Omihachiman; Teruhisa Tsuru, Kameoka; Harufumi Mandai, Takatsuki, all of Japan

[73] Assignee: Murata Manufacturing Co., Ltd., Japan

[21] Appl. No.: 831,075

[22] Filed: Apr. 1, 1997

[30] Foreign Application Priority Data

Apr. 5, 1996 [JP] Japan ..... 8-084026

[51] Int. Cl.[6] ..... H01Q 1/24

[52] U.S. Cl. ..... 343/895; 343/702; 343/873

[58] Field of Search ..... 343/895, 702, 343/700 MS, 873, 872; H01Q 1/24

[56] References Cited

U.S. PATENT DOCUMENTS

| | | | |
|---|---|---|---|
| 4,879,570 | 11/1989 | Takizawa et al. | 343/713 |
| 5,696,517 | 12/1997 | Kawahata et al. | 343/702 |
| 5,764,198 | 6/1998 | Tsuru et al. | 343/702 |

FOREIGN PATENT DOCUMENTS

| | | |
|---|---|---|
| 0762539 | 3/1997 | European Pat. Off. . |
| 0778633 | 6/1997 | European Pat. Off. . |
| 9533287 | 12/1995 | WIPO . |

OTHER PUBLICATIONS

Patent Abstracts of Japan, vol. 18, No. 311, Jun. 14, 1994 & JP 06 069057 A—Mar. 11, 1994 (ABSTRACT).

*Primary Examiner*—Hoanganh Le
*Attorney, Agent, or Firm*—Ostrolenk, Faber, Gerb & Soffen, LLP

[57] ABSTRACT

A chip antenna in which desired antenna characteristics can be obtained without restricting the type of at least one of a dielectric material and a magnetic material used for a base member of the antenna, as well as the type of metal material used for a conductor, or without limiting the sintering conditions of the above-described materials. The chip antenna includes a rectangular-prism-shaped base member having a mounting surface. A conductor, e.g. silver, is spirally wound inside the base member. A feeding terminal is formed over surfaces of the base member so as to feed power to the conductor. One end of the conductor is extended to a surface of the base member to form a feeding section, which is connected to the feeding terminal. The other end of the conductor serves as a free end within the base member. The base member is produced by laminating mixture layers made from a mixture of glass essentially consisting of borosilicate having a softening point of approximately 700° C. and ceramic (relative dielectric constant: 60) essentially consisting of barium oxide, neodymium oxide and titanium oxide having a sintering temperature of approximately 1300° C.

40 Claims, 2 Drawing Sheets

FIG. 2(a)
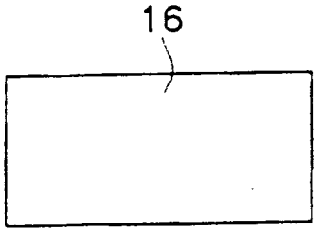
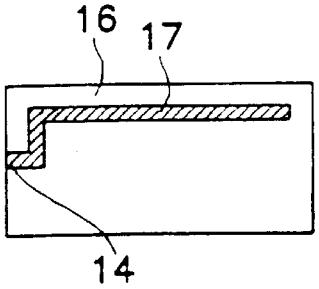
FIG. 2 (b)
FIG. 2(c)
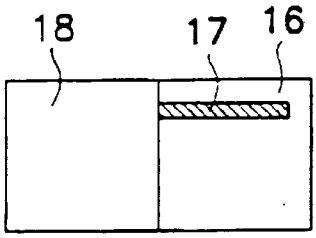
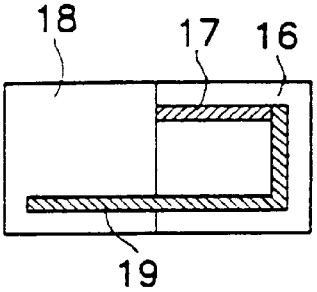
FIG. 2(d)
FIG. 2(e)
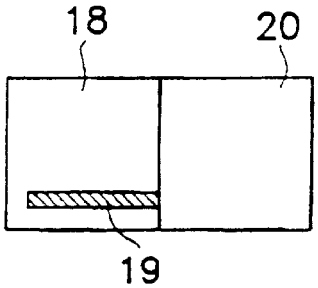
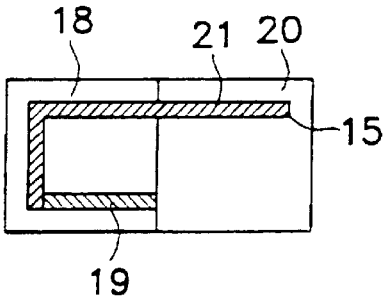
FIG. 2 (f)
FIG. 2(g)
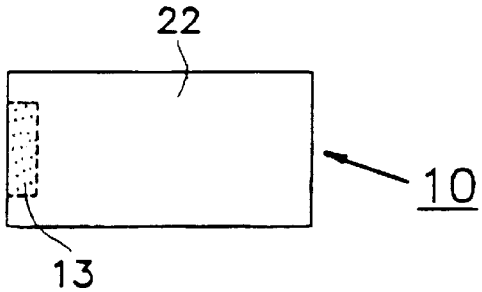

CHIP ANTENNA AND METHOD OF MAKING SAME

BACKGROUND OF THE INVENTION

1. Field of the Invention

The present invention relates generally to chip antennas and, more particularly, to chip antennas used in mobile communications and local area networks (LAN).

2. Description of the Related Art

Referring to a side view of a conventional type of chip antenna shown in FIG. 3, a chip antenna generally indicated by 50 is comprised of: a rectangular-prism-shaped insulator 51 formed by laminating insulating layers (not shown) made from insulating powder, such as alumina or steatite; a conductor 52 made from silver or silver-palladium and formed in a coil-like shape inside the insulator 51; a magnetic member 53 made from magnetic powder, such as ferrite powder, and formed inside the insulator 51 and the coil-shaped conductor 52; and external connecting terminals 54*a* and 54*b*. The connecting terminals 54*a* and 54*b* are attached to the ends of a lead (not shown) of the conductor 52 and baked after the insulator 51, the conductor 52, and the magnetic member 53 are integrally sintered. Namely, the chip antenna 50 is constructed in such a manner that the coil-shaped conductor 52 is wound around the magnetic member 53, and both the elements are encapsulated by the insulator 51.

In the above conventional type of chip antenna, the resonant frequency of the antenna is controlled by the relative magnetic permeability of the magnetic member formed within the coil-shaped conductor. It is necessary that the sintering conditions for the insulating layers, the magnetic layer and the conductor be consistent because the individual elements are integrally sintered after they have been laminated by printing. If, however, a low-melting-point metal, such as gold, silver or copper, is used as a metal for the conductor, the selection for the materials used for the magnetic member should be restricted due to the use of low-melting-point metal. This makes it impossible to obtain desired antenna characteristics, such as the resonant frequency and bandwidth.

SUMMARY OF THE INVENTION

Accordingly, it is an object of the present invention to provide a chip antenna, free from the above-described problem, in which desired antenna characteristics can be obtained without restricting the selection of at least one of a dielectric material and a magnetic material for a base member of the chip antenna, as well as the metal material for a conductor of the antenna, or without limiting the sintering conditions for these materials.

In order to achieve the above and other objects, there is provided a chip antenna comprising: a base member made from at least one of a dielectric material and a magnetic material; at least one conductor formed at least on a surface of and inside the base member; and at least one feeding terminal disposed on a surface of the base member, for applying voltage to the conductor, wherein glass having a melting point lower than the melting point of the conductor, a low-temperature sintered ceramic, or a mixture of glass and ceramic is used as the dielectric material or the magnetic material for the base member.

In this manner, the chip antenna of the present invention is simply constructed in such a manner that at least one conductor is disposed at least on a surface of or inside the base member made from at least one of a dielectric material and a magnetic material. This makes it possible to use glass having a melting point lower than the melting point of the conductor, a low-temperature sintering ceramic, or a mixture of glass and ceramic as the dielectric material or the magnetic material for the base member.

Other features and advantages of the present invention will become apparent from the following description of the invention which refers to the accompanying drawings.

BRIEF DESCRIPTION OF THE DRAWINGS

FIGS. 2(*a*) to 2(*g*) are schematic plan views illustrating the manufacturing process of the chip antenna shown in FIG. 1.

DETAILED DESCRIPTION OF EMBODIMENTS OF THE INVENTION

Figure 1:
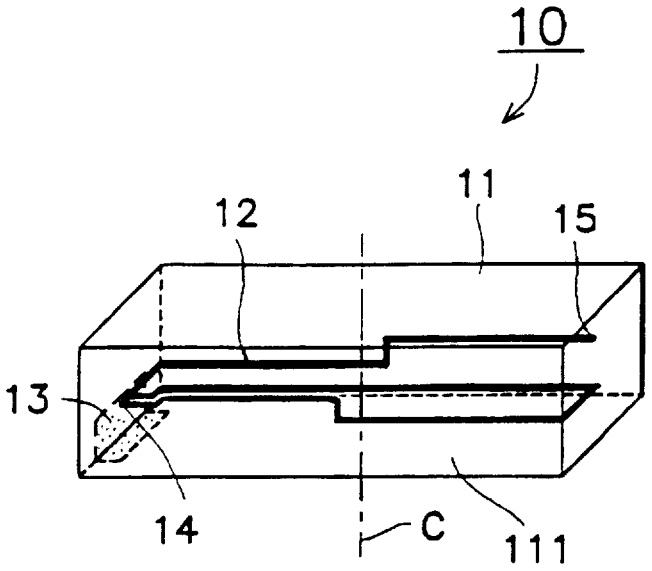
FIG. 1 is a perspective view of a chip antenna according to an embodiment of the present invention.
Figure 3:
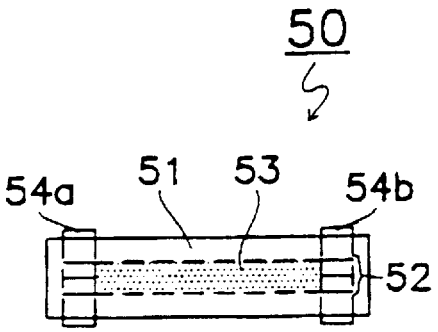
FIG. 3 PRIOR ART
FIG. 3 is a side view of a known type of chip antenna.

Referring to the perspective view of a chip antenna shown in FIG. 1, the chip antenna generally designated by 10 comprises: a rectangular-prism-shaped base member 11 having a mounting surface 111; a conductor 12 made from a low-resistance metal, such as gold, silver or copper, and spirally wound within the base member 11; and a feeding terminal 13 formed over selected surfaces of the base member 11 so as to feed power to the conductor 12. One end of the conductor 12 is extended to the surface of the base member 11 to form a feeding section 14, which is connected to the feeding terminal 13. The other end of the conductor 12 serves as a free end 15 within the base member 11.

The base member 11 is formed by laminating mixture layers (not shown) made from a mixture of glass comprising borosilicate having a softening point at approximately 700° C. and ceramic (relative dielectric constant: 60) comprising barium oxide, neodymium oxide and titanium oxide having a sintering temperature at approximately 1300° C. Since the above type of ceramic per se has a high sintering temperature at about 1300° C., it cannot be, in general, integrally sintered with low-resistance metals, such as gold, silver and copper. However, glass comprising borosilicate can be mixed with the above type of ceramic, and thus, the sintering temperature of the resulting mixture can be reduced to a temperature range from 800° to 1000° C., which range is equivalent to or lower than a melting point of a low-resistance metal used for the conductor.

FIGS. 2(*a*) to 2(*g*) are schematic plan views illustrating the manufacturing process of the chip antenna shown in FIG. 1. As illustrated in FIG. 2(*a*), a mixture layer 16, formed of a mixture of glass comprising borosilicate and ceramic comprising barium oxide, neodymium oxide and titanium oxide, is first laminated by printing. The mixture layer 16 can be made from a mixture paste which is processed by the following manner. Glass comprising borosilicate is ground with a ball mill to have an average particle size of approximately 10 $\mu$m, while ceramic comprising barium oxide, neodymium oxide and titanium oxide is ground with a ball mill to have an average particle size of approximately several $\mu$m. Then, the suitable amounts of varnish and solvent (turpentine oil) are mixed into the above mixture powder of glass and ceramic. The resultant mixture is sufficiently kneaded to obtain a mixture paste.

Then, a conductive pattern 17 formed generally in an "L" shape having the feeding section 14 at one end is printed, as shown in FIG. 2(*b*), on the mixture layer 16 and then dried. The conductive pattern 17 can be produced from a conductive paste which is processed by the following fashion. Suitable amounts of varnish and solvent (turpentine oil) are mixed into silver powder having an average particle size of approximately 50 $\mu$m, and the resultant mixture is adequately kneaded to obtain a conductive paste.

Subsequently, a mixture layer 18 is printed, as illustrated in FIG. 2(*c*), to cover the left half of the conductive pattern 17 and the left half of the mixture layer 16. A conductive pattern 19 formed generally in an "L" shape is then printed, as shown in FIG. 2(*d*), so that one end of the pattern 19 can be superimposed on the edge of the conductive pattern 17, and then dried.

Thereafter, a mixture layer 20 is printed, as shown in FIG. 2(*e*), on the right half of the mixture layer 16. In this manner, the process steps indicated in FIGS. 2(*c*) to 2(*e*) (except for the formation for the feeding section 14) is repeated a predetermined number of times. At this time, a conductive pattern 21 formed generally in an "L" shape and having one end of the pattern 21 serving as a free end 15 is printed, as shown in FIG. 2(*f*), in such a manner that the other end of the pattern 21 is superimposed on the edge of the conductive pattern 19. The conductive patterns 19 and 21 are then dried.

Finally, a mixture layer 22 is printed, as illustrated in FIG. 2(*g*), on the overall surface of the mixture layer 20 and then dried to complete this laminating process. In this fashion, the laminated structure produced by repeating the process of printing→drying→printing→drying . . . is sintered under predetermined conditions; for example, heating the laminated structure at a temperature of approximately 300° C. in air, to burn the organic component contained in the structure, followed by heating the structure for about ten minutes at approximately 800° C., thereby producing the integrally sintered structure. Then, the feeding terminal 13 is attached to the feeding section 14 of the conductor 2 and then baked to complete the chip antenna 10.

According to the aforedescribed manufacturing process, the mixture layers 16, 18, 20 and 22 and the conductive patterns 17, 19 and 21 are laminated and sintered. As a consequence, the chip antenna 10 can be obtained, as illustrated in FIG. 1, which has the conductor 12 spirally wound inside the rectangular-prism-shaped base member 11 provided with a mounting surface 111 along its height. The mixture layers 18, 20 and 22 are made from a mixture paste similar to the paste used for the mixture layer 16, while the conductive patterns 19 and 21 are produced from a conductive paste similar to the paste for the conductive pattern 17. The relative dielectric constant of the base member 11 made from a mixture of glass comprising borosilicate and ceramic comprising barium oxide, neodymium oxide and titanium oxide is approximately 20.

The antenna characteristics (resonant frequency, standing wave ratio, and bandwidth) of the chip antenna 10 manufactured according to the above-described process were measured. The results are shown in Table 1.

TABLE 1

| Resonant frequency (MHz) | Standing wave ratio | Bandwidth |
|---|---|---|
| 470 | 1.51 | 21 |

Table 1 shows that sufficient antenna characteristics can be obtained when the base member is formed by using a mixture of glass, having a melting point lower than the melting point of the metal used for the conductor, and ceramic.

Although the specific materials for the base member have been described in this embodiment, they are not exclusive, and other materials may be used as long as they have melting points lower than the melting point of the metal used for the conductor. Glass may include cordierite, mullite, anorthite, celsian, spine, gahnite, dolomite, petalite, and substituted derivatives thereof. The composition of glass frit is controlled so that at least one type of the above components is precipitated after glass frit has been fired.

The composition of the glass frit to achieve the precipitation of anorthite glass may be, for example, silicon oxide-aluminum oxide-boron oxide-calcium oxide. The composition of glass frit to attain the precipitation of cordierite/anorthite/gahnite glass may be, for example, magnesium oxide-aluminum oxide-silicon oxide-zinc oxide-calcium oxide-boron oxide-calcium oxide. Further, the composition of glass frit to accomplish the precipitation of cordierite/gahnite glass may be, for example, magnesium oxide-aluminum oxide-silicon oxide-zinc oxide-boron oxide.

Additionally, low-temperature sintering ceramic may include, for example, tin barium borate and zirconium barium borate. Further, ceramic may include, for example, at least one type of the components selected from the group of alumina, cristobalite, quartz, corundum, mullite, zirconia, and cordierite.

Although in the foregoing embodiment the conductor for use in the chip antenna is spirally wound along the height of the base member, it may be wound in the longitudinal direction of the base member.

Also, an embodiment has been explained in which the cross-sectional shape of the spirally wound conductor crossing at right angles with the winding axis C is generally rectangular. However, it may be in other shapes as long as it partially has a linear portion, in which case, a resulting antenna can exhibit directivity, not only along the winding axis, but also in a direction extended from the linear portion. It is thus possible to achieve an antenna with improved directivity as compared with an antenna in which the winding conductor has a circular cross section.

Further, although an embodiment has been explained in which the conductor is spirally wound, it may be formed in a meandering shape. Additionally, in this embodiment the conductor is disposed inside the base member. However, the conductor may be provided on the surface of the base member, or may be disposed both on and inside the base member. Only one conductor is used in the above-described embodiment, but two or more conductors may be formed, in which case, the resulting antenna can possess a plurality of resonant frequencies. Moreover, although the base member is rectangular-prism shaped, it may be formed in other shapes, such as a cube, cylinder, pyramid, cone, or sphere. Additionally, the position of the feeding terminal specified in this embodiment is not essential to carry out the present invention.

As will be clearly understood from the foregoing description, the chip antenna of the present invention offers the following advantages.

The chip antenna is simply constructed in such a manner that at least one conductor is disposed at least on the surface of or inside the base member made from at least one of a dielectric material and a magnetic material. Accordingly, glass having a melting point lower than the melting point of the metal used for the conductor, low-temperature sintering ceramic, or a mixture of glass and ceramic can be used as the dielectric material or the magnetic material for the base member. Thus, the use of low-melting-point and low-resistance metal for the conductor does not restrict the type of dielectric material and magnetic material or the sintering conditions for these materials, thereby extending the range of choices for the base material.

Additionally, if a mixture of glass and ceramic is employed for the base member, various types of these components can be combined, thereby achieving high levels of relative dielectric constant and relative magnetic permeability, which has not been conventionally feasible due to the limitations concerning temperatures. Hence, chip antennas having various antenna characteristics can be obtained.

Although the present invention has been described in relation to particular embodiments thereof, many other variations and modifications and other uses will become apparent to those skilled in the art. Therefore, the present invention should be limited not by the specific disclosure herein, but only by the appended claims.

What is claimed is:

1. A chip antenna comprising:

a base member comprising at least one of a dielectric material and a magnetic material;

at least one conductor formed at least one of on a surface of the base member and inside said base member; and at least one feeding terminal disposed on a surface of said base member, for applying voltage to said conductor;

said base member comprising at least one of a glass having a melting point lower than the melting point of said conductor, a low-temperature sintering ceramic, and a mixture of glass and ceramic.

2. The chip antenna of claim 1, wherein the base member comprises a mixture comprising glass comprising borosilicate having a softening point at approximately 700° C. and ceramic comprising barium oxide, neodymium oxide and titanium oxide having a sintering temperature at approximately 1300° C., said mixture having a sintering temperature range of approximately 800° to 1000° C.

3. The chip antenna of claim 2, wherein the base member comprises a plurality of layers of said mixture with said conductor deposited between said layers in sections, the sections being attached together and taken as a whole comprising said conductor.

4. The chip antenna of claim 3, wherein a section of the conductor is deposited on a mixture layer, followed by a further mixture layer covering a portion of said conductor section, followed by a further conductor section connected to the first conductor section, and covering said further mixture layer, with at least one further mixture layer and at least one further conductor section being deposited so that a predetermined plurality of layers are provided with conductor sections therebetween in said base member.

5. The chip antenna of claim 4, further wherein each section of the conductor is dried prior to applying a further mixture layer.

6. The chip antenna of claim 5, wherein the base member having the conductor therein is heated at a temperature of approximately 300° C. in air to burn an organic component and then heated at a temperature of approximately 800° C. to sinter it.

7. The chip antenna of claim 6, wherein the feeding terminal is attached to the base member in contact with the conductor, with the base member thereafter being baked.

8. The chip antenna of claim 1, wherein the conductor comprises at least one of copper, gold and silver.

9. The chip antenna of claim 1, wherein the conductor has a rectangular cross-section.

10. The chip antenna of claim 1, wherein the conductor has at least one linear portion in cross-section.

11. The chip antenna of claim 1, wherein the conductor is formed as a spiral.

12. The chip antenna of claim 1, wherein the glass comprises at least one of cordierite, mullite, anorthite, celsian, spine, gahnite, dolomite, petalite, and derivatives thereof.

13. The chip antenna of claim 1, wherein the ceramic comprises at least one of tin barium borate, zirconium barium borate, alumina, cristobalite, quartz, corundum, mullite, zirconia and cordierite.

14. The chip antenna of claim 1, wherein the conductor has a meandering shape.

15. The chip antenna of claim 1, wherein the conductor is disposed on a surface of the base member.

16. The chip antenna of claim 1, wherein the conductor is disposed partly in the base member and partly on a surface of the base member.

17. The chip antenna of claim 1, wherein there are provided a plurality of conductors.

18. The chip antenna of claim 17, wherein the plurality of conductors provide the chip antenna with a plurality of resonant frequencies.

19. The chip antenna of claim 1, wherein the base member is one of a rectangular prism, cube, cylinder, pyramid, cone and sphere.

20. The chip antenna of claim 1, wherein one end of the conductor is coupled to the feeding terminal and a second end comprises a free end.

21. A method of making a chip antenna comprising the steps of:

forming a base member comprising at least one of a dielectric material and a magnetic material;

forming at least one conductor at least one of on a surface of the base member and inside said base member; and disposing at least one feeding terminal on a surface of said base member, for applying voltage to said conductor;

said step of forming a base member further comprising:

forming said base member from at least one of a glass having a melting point lower than the melting point of said conductor, a low-temperature sintering ceramic, and a mixture of glass and ceramic.

22. The method of claim 21, wherein the step of forming the base member comprises providing a mixture comprising glass comprising borosilicate having a softening point at approximately 700° C. and ceramic comprising barium oxide, neodymium oxide and titanium oxide having a sintering temperature at approximately 1300° C., said mixture having a sintering temperature range of approximately 800° to 1000° C.

23. The method of claim 22, wherein the step of forming the base member comprises providing a plurality of layers of said mixture with said conductor deposited between said layers in sections, the sections being attached together and taken as a whole comprising said conductor.

24. The antenna of claim 23, wherein the steps of forming the base member and the conductor comprise the step of depositing a section of the conductor on a mixture layer, followed by forming a further mixture layer covering a portion of said conductor section, followed by depositing a further conductor section connected to the first conductor section and covering said further mixture layer, with said steps of forming a further mixture layer and a further conductor section being repeated a predetermined plurality of times until said base member with the conductor therein is formed.

25. The method of claim 24, further comprising drying each section of the conductor prior to applying a further mixture layer.

26. The method of claim 25, further comprising heating the base member having the conductor therein at a temperature of approximately 300° C. in air to burn an organic component and then heating at a temperature of approximately 800° C. to sinter it.

27. The method of claim 26, further comprising attaching the feeding terminal to the base member in contact with the conductor, and thereafter baking the base member.

28. The method of claim 21, wherein the step of forming at least one conductor comprises forming the conductor of at least one of copper, gold and silver.

29. The method of claim 21, wherein the step of forming the at least one conductor comprises forming the conductor with a rectangular cross-section.

30. The method of claim 21, wherein the step of forming the at least one conductor comprise forming the conductor with at least one linear portion in cross-section.

31. The method of claim 21, wherein the step of forming the at least one conductor comprises forming the conductor as a spiral.

32. The method of claim 21, wherein the step of forming the base member comprises forming the base member of glass comprising at least one of cordierite, mullite, anorthite, celsian, spine, gahnite, dolomite, petalite, and derivatives thereof.

33. The method of claim 21, wherein the step of forming the base member comprises forming the base member of ceramic comprising at least one of tin barium borate, zirconium barium borate, alumina, cristobalite, quartz, corundum, mullite, zirconia and cordierite.

34. The method of claim 21, wherein the step of forming the conductor comprises forming the conductor with a meandering shape.

35. The method of claim 21, wherein the step of forming the conductor comprises forming the conductor on a surface of the base member.

36. The method of claim 21, wherein the step of forming the conductor comprises forming the conductor partly in the base member and partly on a surface of the base member.

37. The method of claim 21, wherein the step of forming the conductor comprises forming the conductor as a plurality of conductors.

38. The method of claim 37, wherein the plurality of conductors provide the chip antenna with a plurality of resonant frequencies.

39. The method of claim 21, wherein the step of forming the base member comprises forming the base member as one of a rectangular prism, cube, cylinder, pyramid, cone and sphere.

40. The method of claim 21, wherein the step of forming the conductor comprises forming one end of the conductor coupled to the feeding terminal and a second end as a free end.

* * * * *